United States Patent [19]

Carter et al.

[11] Patent Number: 4,953,298

[45] Date of Patent: Sep. 4, 1990

[54] KILN CONTROLLER

[75] Inventors: John L. Carter, Portland; Michael M. Sprague, Tigard; Crosby Stone, Eugene; James A. Felsheim, Rogue River, all of Oreg.

[73] Assignee: Wagner Electronic Products, Inc., Rogue River, Oreg.

[21] Appl. No.: 315,153

[22] Filed: Feb. 24, 1989

[51] Int. Cl.[5] ..... F26B 11/12

[52] U.S. Cl. ..... 34/44; 34/16.5; 34/54

[58] Field of Search ..... 34/13.8, 16.5, 191, 34/44, 45, 46, 50, 54, 43; 432/1

[56] References Cited

U.S. PATENT DOCUMENTS 3,896,558 7/1975 Lovgren ..... 34/13.8

*Primary Examiner*—Henry A. Bennet

*Attorney, Agent, or Firm*—Dellett, Smith-Hall and Bedell

[57] ABSTRACT

A kiln controller controls the drying of lumber in a kiln by executing a drying schedule and adjusting the drying schedule in response to actual measured conditions in the kiln. A computer within the controller controls heating coils, spray nozzles and vents in the kiln to achieve the conditions prescribed in the drying schedule. The computer first executes a routine whereby the kiln temperature is brought up to a desired initial temperature. Then the computer concurrently executes the drying schedule and a routine wherein it monitors the temperature, vent load and spray nozzle activity, and automatically adjusts the duration of the current step in the drying schedule.

14 Claims, 10 Drawing Sheets

KILN CONTROLLER

BACKGROUND OF THE INVENTION

The present invention relates to a controller for controlling the drying of lumber in a kiln.

It is very important to dry lumber effectively and efficiently since the way lumber dries will affect its quality and final moisture content. Furthermore, the time and energy required must be considered when determining the drying method. Allowing lumber to dry naturally may not decrease the quality of the lumber substantially but will take a very long time and may not reduce the moisture content of the lumber to the desired level. If the lumber dries in a controlled environment at a constant temperature and humidity for an indefinite period of time it will eventually stabilize at a certain moisture content defined as the Equilibrium Moisture Content (EMC). The EMC is the percentage of water by weight in the lumber relative to the dry weight of the lumber. For the purpose of drying lumber, the EMC can be thought of as the amount of force applied to the lumber to draw the moisture out of the lumber, i.e. the lower the EMC, the more drying force is exerted on the lumber. By drying the lumber at varying EMC's for selected periods of time, the total drying time can be reduced, with the trade off for reducing the drying time being a possible decrease in the quality (degrading) of the lumber.

A kiln, having heating coils, steam spray nozzles, and vents for adjusting the temperature and humidity levels inside the kiln, provides such a controlled environment. A drying schedule of temperature and humidity levels regulates the drying of the lumber wherein the schedule comprises a number of steps having dry bulb temperature and wet bulb temperature set points derived from test data taken for varying EMC levels. The difference between the dry and wet bulb temperature set points, which determines the relative humidity inside the kiln, is called the wet bulb depression and indicates the drying force on the wood. Increasing the wet bulb depression increases the force on the wood.

Lumber degrades the most in the later stages of the drying schedule after reaching a point called fiber saturation which occurs when all of the water left in the lumber is confined inside the fiber structure of the wood fiber cells. Lumber is susceptible to warping, twisting, cracking, checking, staining, case hardening (collapsing of the cell walls in the outer layers of the lumber), and honeycombing (collapsing of cell walls throughout the lumber). In a kiln drying vast quantities of lumber, the lumber will dry at varying rates, and therefore it is desirable to maintain a drying force sufficient to dry the wet lumber and not substantially degrade the drier lumber. A schedule with closely controlled EMC's helps to avoid these problems.

As the lumber dries, it becomes increasingly difficult to draw the moisture out of the lumber. At a constant EMC, the lumber eventually reaches a plateau where no more moisture evaporates from the lumber, and therefore more force must be applied to the lumber by decreasing the EMC. This is accomplished by either holding the dry bulb temperature set point constant and lowering the wet bulb temperature set point, holding the wet bulb temperature set point constant and raising the dry bulb temperature set point, or a combination of changing both set points to increase the wet bulb depression.

The drying schedules for the kiln are executed by a kiln controller. One such controller involves a mechanical "cam" which rotates slowly on a shaft with the edges of the cam adjusting the dry and wet bulb temperature set points. Pneumatic information fed back from dry and wet bulb temperature sensors allows the cam to adjust the temperatures over a limited range. The mechanical cam has no capabilities for making self-correcting decisions, and a new set of cams must be cut for each schedule and may not be adjusted if the schedule isn't quite right.

An on-off controller operates similarly to a thermostat or humidity switch. If the dry and wet bulb temperatures are below the schedule values, the heating coils and spray nozzles are turned on, and if the temperatures are too high they are turned off. A vent is either opened or closed depending on the relative humidity in the kiln.

A computer driven kiln controller executes the drying schedule more effectively and with a greater degree of flexibility than either the mechanical cam or the on-off controller. The computer uses the dry and wet bulb temperature set points prescribed in the drying schedule and actual dry and wet bulb temperatures in the kiln to adjust the heating coils, steam spray nozzles, and vents to achieve the desired temperature and humidity levels. Dry and wet bulb sensors in the kiln provide the actual temperature information. Moreover, the schedule can be entered into the computer via a user interface on the controller and may be changed at any time.

For example, in a typical drying schedule the first step consists of bringing the temperature in the kiln up to an initial temperature where the drying force on the lumber is fairly mild (high EMC). The computer calculates intermediate set points which increase evenly and slowly. These set points are passed on to an algorithm that attempts to make the actual temperature agree with the set point temperatures by controlling the heating coils, steam spray nozzles, and vents. At first, the set point temperatures sent to the algorithm are higher than the actual temperatures, so the heating coils are turned on high. Shortly thereafter, a large heat rise will occur in the kiln as the coils heat the air, and the controller responds by shutting off the heating coils entirely. Eventually the air cools and the heating coils are turned on again; however, the controller has lost time in heating the kiln. The kiln temperature will continue to rise above and drop below the set points as the heating coils are turned on and off. Therefore, after the first step has elapsed, the kiln may be above or below the desired initial temperature. Achieving the initial kiln temperature in the manner described hereinabove may waste time and energy, and may not provide an accurate initial temperature.

The second step may hold at the initial conditions for a period of time estimated to be sufficient to reach fiber saturation. Then a step could ramp the dry and wet bulb temperature set points to apply a greater drying force to the lumber. The ramping step may take a few hours or a few days depending on the condition of the lumber. The last step holds at the final conditions of the ramp step for a period of time estimated to be sufficient to completely dry the lumber.

An experienced kiln operator constructs a schedule by choosing dry and wet bulb temperature set points and step lengths based on personal experience, knowledge of the lumber and the test data available for selecting the set points for desired EMC's. Still, the schedule reflects a best guess and probably won't be the optimum drying schedule. For example, if the lumber is initially very wet it may not be dry when the schedule is complete. If the lumber is very dry, a lot of time and heat energy may be wasted and the lumber may be degraded if the force on the lumber is increased after fiber saturation is reached. If the ramp step increases too fast the lumber may be damaged, and if it increases too slowly, time and energy are wasted. Therefore, an inaccurate drying schedule will degrade the lumber and increase the cost of drying.

SUMMARY OF THE INVENTION

In a kiln controller a computer executes a schedule for drying lumber in a kiln. The schedule prescribes a plurality of steps of variable duration having dry and wet bulb temperature set points. In response to the actual dry and wet bulb temperatures in the kiln, the controller controls the heating coils, steam spray nozzles and vents to achieve the desired set points.

In accordance with a feature of the present invention, the computer within the controller executes an auto-advance routine wherein it monitors the dry temperature, steam spray nozzles and vents and automatically adjusts the duration of the current step in the schedule so that the lumber dries more consistently. The computer first receives the measured dry bulb temperature, the steam spray nozzle position and the vent load and accumulates this data for a desired period. Thereafter, the computer calculates the average temperature and vent load and accumulates the number of times the spray nozzle supplies steam to the kiln, and compares them to desired values respectively. Based on this comparison the computer will increase, decrease or not alter the duration of the current step.

In accordance with another aspect of the present invention, the computer executes an auto start-up routine wherein it quickly and consistently increases the temperature in the kiln to a desired initial temperature. The computer first establishes a set point near the measured temperature in the kiln and adjusts the heating coils for such a temperature. When the temperature in the kiln surpasses the set point temperature, the set point temperature is increased so that it exceeds the kiln temperature thereby causing the computer to adjust the heating coils to provide more heat to the kiln. This cycle continues until the kiln temperature reaches the desired initial temperature.

It is accordingly an object of the invention to provide a better schedule for drying lumber in a kiln.

It is another object of the invention to increase the quality of kiln dried lumber.

It is also an object of the invention to provide a more efficient method for drying lumber in a kiln.

It is further an object of the invention to adjust the duration of the current step in a schedule to more effectively dry lumber.

It is yet another object of the invention to provide an improved method for increasing the temperature in the kiln to a desired initial temperature.

The subject matter of the present invention is particularly pointed out and distinctly claimed in the concluding portion of the specification. However, both the organization and method of operation of the invention, together with further advantages and objects thereof, may best be understood by reference to the following description in connection with the accompanying drawings wherein like reference characters refer to like elements.

DESCRIPTION OF THE PREFERRED EMBODIMENT

As indicated above, the present invention relates to a kiln controller for controlling the drying of lumber in a kiln. To facilitate understanding of the invention, the configuration of a normal kiln and kiln controller, and the operation of a typical drying schedule, are described and the improvement is described thereafter.

Figure 1:
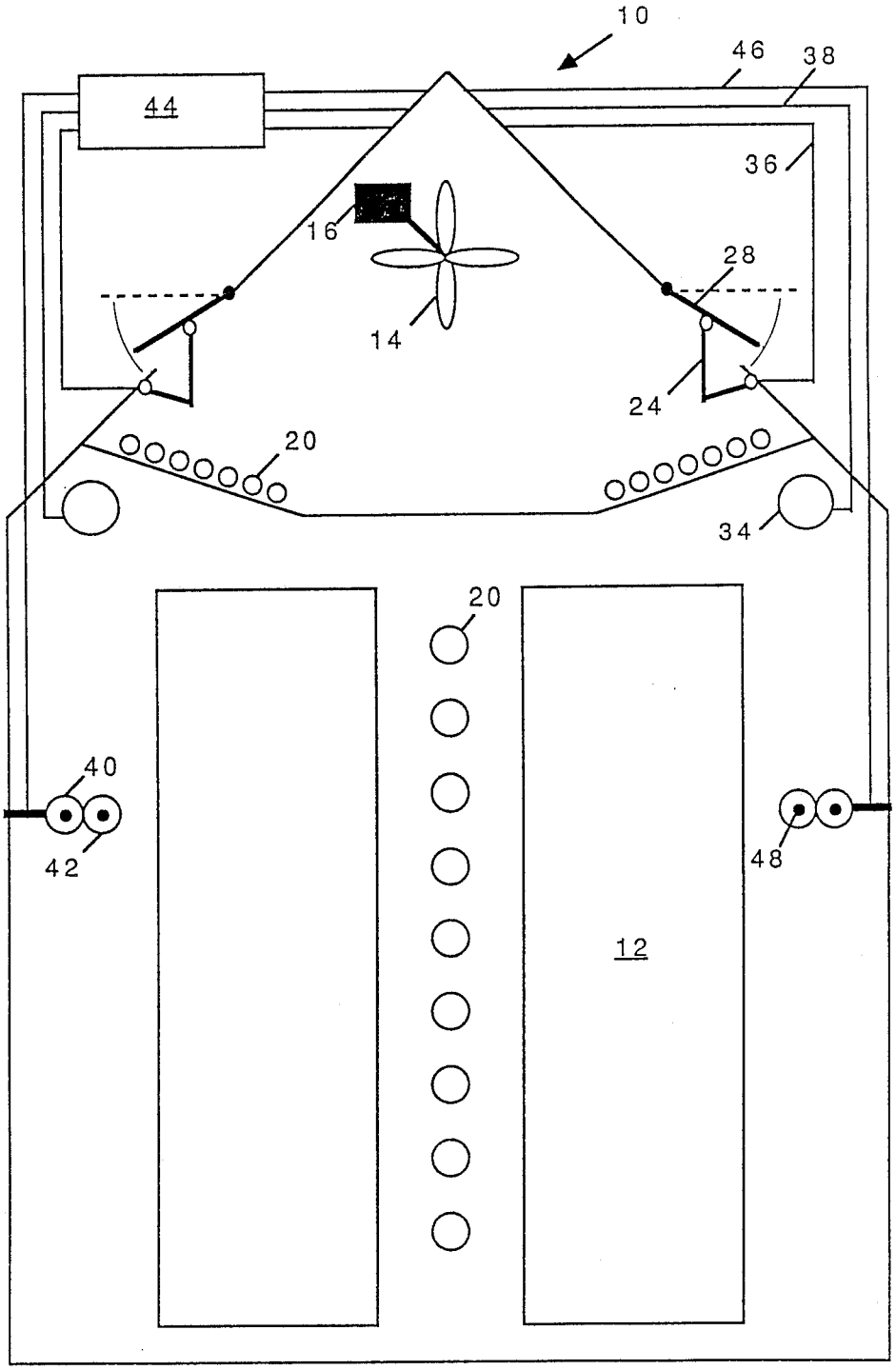
FIG. 1 is a view of a kiln including heating coils, steam spray nozzles, vents, and wet and dry bulb sensors.

FIG. 1 illustrates the relevant portions of a kiln 10 in cross-sectional and somewhat schematic form. Kiln 10 is suitably a large brick building constructed to hold vast quantities of lumber 12 and provide a controllable environment capable of extreme temperatures and humidity levels. The lumber 12 is stacked so that air can circulate around the lumber and the moisture in the lumber can evaporate. A fan 14 driven by a motor 16 circulates the air in the kiln over the heating coils to heat the air, across the lumber thereby transferring the heat in the air to the lumber while absorbing moisture from the lumber and carrying the water away from the lumber.

Steam valves 18 (FIG. 2) control the temperature in kiln 10 by increasing or decreasing the amount of steam introduced into hollow heating coils 20, wherein steam input 22 supplies steam to the coils 20 through valve 18 and the steam returns through steam return 21. Air pressure in pneumatic line 23 controls the positioning of steam valve 18. Vent actuator 24 and steam valve 26 (FIG. 2) control the humidity level in kiln 10 by opening or closing vents 28 and by increasing or decreasing the amount of steam introduced into kiln 10 via steam spray nozzles 34. Steam input 32 supplies steam to spray nozzles 34 through valve 26.

Air pressure in pneumatic lines 36 and 38 controls the positioning of vent actuator 24 and steam valve 26. The "vent load" of vent 28 corresponds to the pressure in pneumatic line 36 indicating the position of the vent and providing a measure of the evaporation rate of moisture in the lumber. The kiln obtains its maximum humidity level when the vents 28 are closed thereby preventing the escape of air with a high moisture content, and spray nozzles 34 are set to introduce steam into the kiln. Contrariwise, opening vents 28 and turning off spray nozzles 34 decreases the humidity level in the kiln.

Dry and wet bulb sensors 40 and 42 respectively convey the temperature and humidity level in the kiln to a kiln controller 44 through cables 46 wherein the sensors are characterized by a resistance which varies in an established manner relative to temperature. Furthermore, a wick 48 covers the sensing element of the wet bulb sensor 42 and is kept wet such that comparing the dry and wet bulb temperature provides a measure of the relative humidity in the kiln in a known manner. The rate at which the moisture in the wick evaporates corresponds to the relative humidity and if the air is humid, little evaporation will occur and the dry and wet bulb readings will be close to the same value. If the air is dry, moisture will evaporate quickly and heat energy will be transferred to the gaseous water thereby removing heat energy from the surrounding air. This loss of heat energy, i.e. temperature, in comparison with the dry bulb reading is the wet bulb depression.

Figure 2:
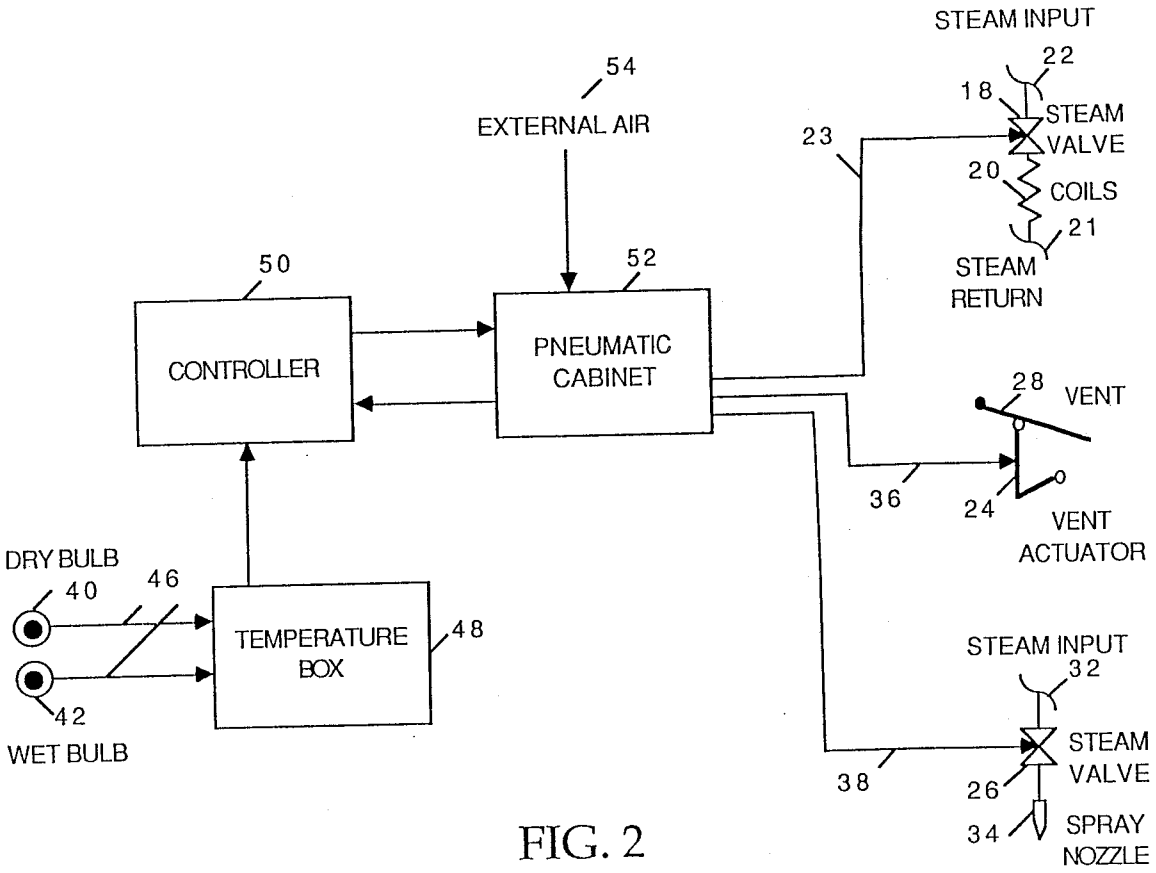
FIGS. 2–4 are block diagrams of relevant portions of a kiln controller.

FIG. 2 illustrates relevant portions of kiln controller 44 and interactions between the controller and the kiln for executing a drying schedule for the lumber in the kiln. Kiln controller 44 comprises a temperature box 48, a controller 50, and a pneumatic cabinet 52. Temperature box 48 receives the temperature readings from the dry and wet bulb sensors 40 and 42, and sends the data to controller 50. There may be a number of dry and wet bulb sensors in the kiln wherein their corresponding temperature readings may vary due to air flow or inconsistent heating. For instance, if the dry bulb temperatures vary due to air flow, the controller selects the higher temperature and determines the direction of air flow. Pneumatic cabinet 52 converts the current pneumatic line pressures to analog signals and sends the data to controller 50. Controller 50 receives the temperature and current line pressure data, performs an analog to digital (A/D) conversion, and calculates pressure values for pneumatic lines 23, 36, and 38 which control steam valve 18, vent actuator 24, and steam valve 26 respectively. Controller 50 compares the calculated pressure values to the current pressure values and sends control pulses to either increase the pressure to pneumatic cabinet 52 in pneumatic lines 23, 36 and 38 by introducing high pressure external air 54 or decrease the line pressure by exhausting air in the pneumatic lines. External air source 54 supplies air to pneumatic cabinet 52 for pressurizing the pneumatic lines.

Figure 3:
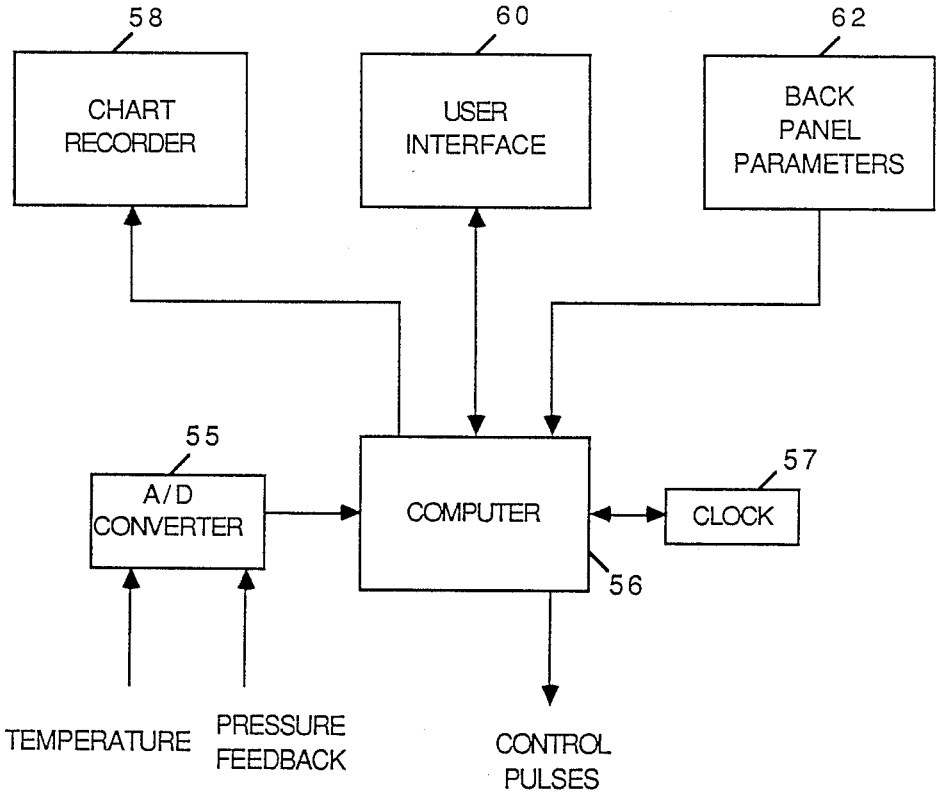

FIG. 3 is a block diagram illustrating controller 50 of FIG. 2 in more detail. The temperature data from temperature box 48 and the current line pressure from pneumatic cabinet 52 are input to an A/D converter 55 transmitting digital signals to a computer 56. Computer 56 sends temperature information to a chart recorder 58 which records the temperature and relative humidity in the kiln over the course of the entire drying schedule. Computer 56 has an internal clock 57. A user interface 60 provides computer 56 with the drying schedule, manual inputs and other control information. Computer 56 communicates the dry and wet bulb temperatures, the EMC, direction of air flow and the status of the drying schedule to user interface 60 while back panel parameters 62 provide the desired values for the vent load, activity of the spray nozzle and the dry temperature in the kiln. These values, determined from past drying data, may be adjusted by an operator to suit the particular kiln. The values indicate nominal levels of venting, steam and temperature that should occur in the kiln throughout the schedule. When the actual values deviate substantially from these nominal values, then in accordance with the invention as described hereinbelow, the schedule is adjusted so that the lumber dries more efficiently.

Figure 4:
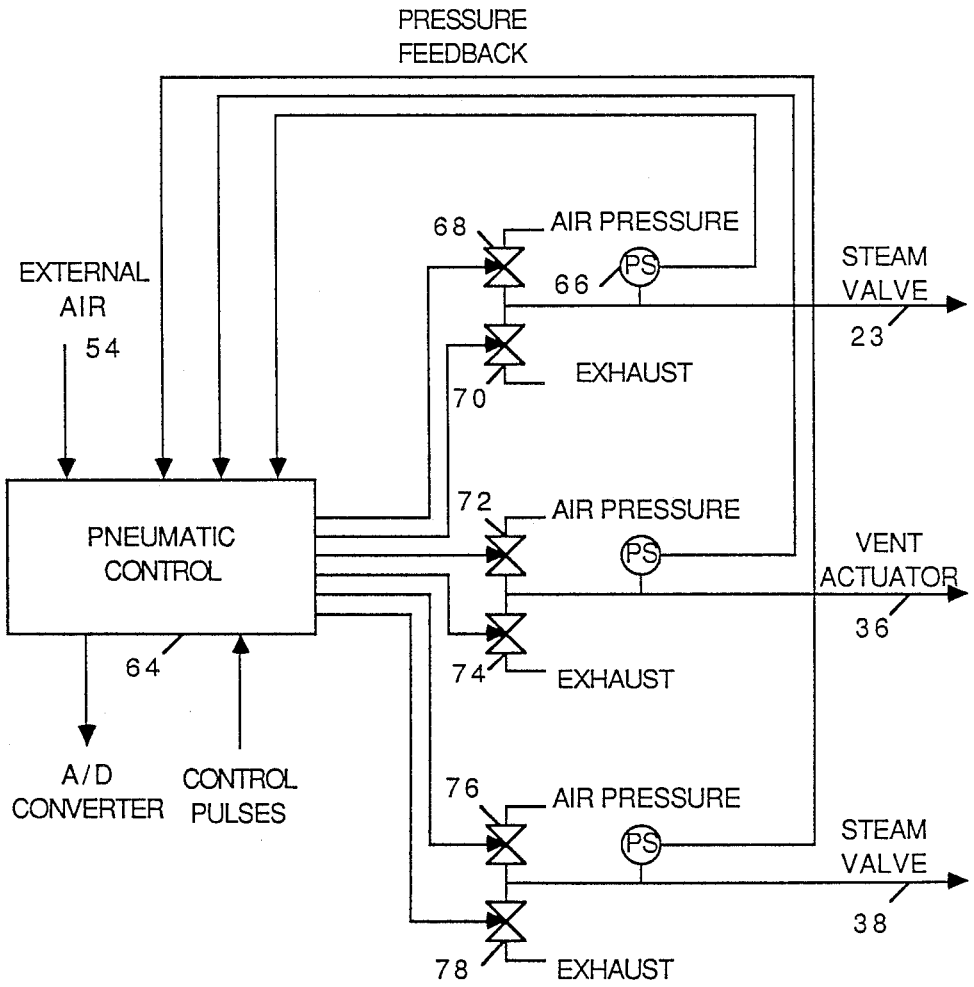

FIG. 4 illustrates the pneumatic cabinet 52 of FIG. 2 in more detail. A pneumatic controller 64 receives the control pulses from computer 56 and monitors the current pressure in the pneumatic lines through sensors 66. By comparing the calculated value to the current value, computer 56 decides whether the air pressure in the respective pneumatic line needs to be increased or decreased. For example, if the current pressure in pneumatic line 23 is below the calculated value, computer 56 emits a control pulse such that controller 64 opens an air valve 68 allowing air to flow from external air supply 54 to the pneumatic line 23 thereby increasing the pressure in the line. If the current line pressure is above the calculated value, computer 56 emits a control pulse such that controller 64 opens an exhaust valve 70 allowing air to escape from the pneumatic line 23 thereby decreasing the pressure in the line. Air valve 68 and exhaust valve 70 can not be open at the same time. Furthermore, when either valve is opened, it remains open only momentarily thereby changing the pressure in line 23 only slightly. Valves 72 and 74, and valves 76 and 78 function similarly in conjunction with pneumatic lines 36 and 38.

Figure 5:
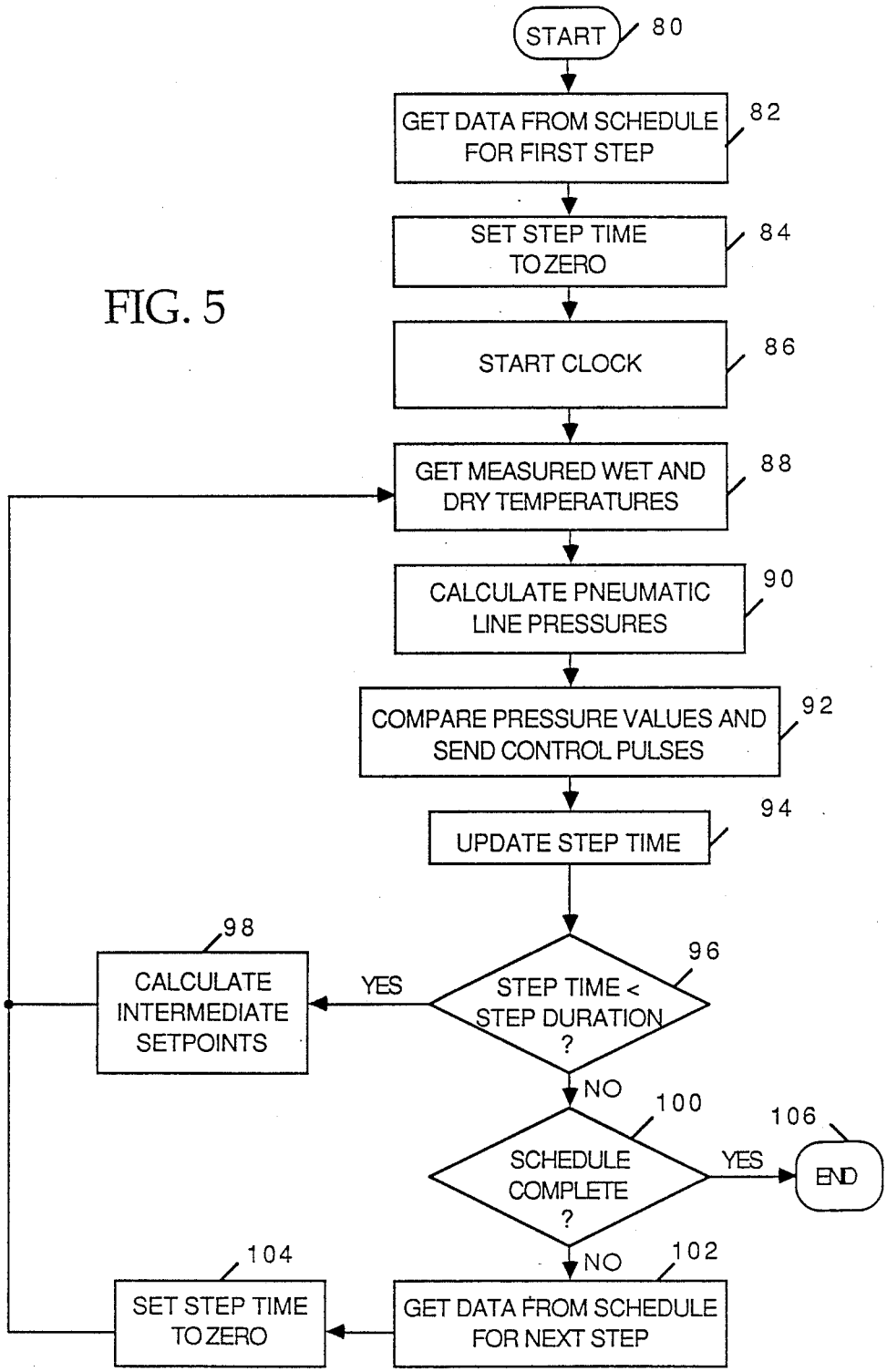
FIG. 5 is a flow chart illustrating operation of the computer in FIG. 3 in carrying out the normal drying schedule.

FIG. 5 is a flow chart embodying the major steps carried out by computer 56 in executing the drying schedule. Computer 56 receives data for the first step of the drying schedule including the initial dry and wet temperature set points, the target dry and wet temperature set points, and the step duration (step 82). If the step is a HOLD step, the initial and target set points will be the same. Target set points that vary from the initial set points indicate some kind of a RAMP step. The computer sets the step time to zero (step 84) and starts internal clock 57 (step 86).

The computer obtains the measured wet and dry temperatures from temperature box 48 via A/D converter 55 (step 88). Using the measured temperatures and the set points as inputs to a PID (Proportion-Integral-Derivative) algorithm, the computer calculates pressure values for the pneumatic lines (step 90). The PID algorithm is discussed in detail hereinbelow. The computer compares the current line pressures to the calculated pressures and sends the appropriate control pulses to pneumatic controller 64 (step 92) and updates the step time (step 94).

In step 96 the computer compares the step time to the step duration. If the step time is less than the step duration, the computer calculates intermediate set points (step 98). For a HOLD step, the set points do not change, but for a RAMP step they vary linearly between the set points. Steps 88, 90, 92, 94, 96, and 98 are repeated until the step time reaches the step duration in step 96, whereupon the computer checks to see whether the schedule is complete (step 100). If not, the computer receives the data from the drying schedule for the next step (step 102), sets the step time to zero (step 104) and repeats steps 88–104 until the schedule is found to be complete in step 100 whereby execution of the drying schedule ends at step 106.

The PID algorithm is a three mode feedback control algorithm described by the discrete equation as follows:

$$m = Kc\left[E_i + T^*Ki\sum_{j=1}^{i} E_j + (Kd/t)^*(E_i - E_{i-1})\right] \quad (1)$$

where m=controller output in p.s.i.

$E_i$=error at ith sampling interval $E_{i-1}$=error at previous sampling interval T=sampling interval
Ki=integration time constant
Kd=derivative time constant
Kc=proportional gain
t=time The three modes or methods the controller uses to adjust to an error signal are described as follows:

Proportional:

A linear response directly proportional to the magnitude of the input or error signal characterizes the Proportional term of the control equation. The error signal is the deviation from the controller set point and is expressed in degrees Fahrenheit.

Integral:

The Integral term modifies the output of the equation by integrating the error term, and multiplying the result by an adjustable gain parameter, Ki. Summing all of the errors from the first sample to the current sample, as shown in equation 1, accomplishes the integration of the error term. This term compensates for dynamically changing load conditions in the kiln. For example, during the beginning of the drying schedule, much more energy is required to maintain a given temperature in the kiln than is required near the end of the schedule when most of the moisture has been drawn out of the lumber. With just the Proportional control, the actual temperature in the kiln would deviate from the set point by an amount based on the energy required to maintain the set point, and the actual output value from the control equation. This corresponds to "droop". The Integral term of the equation accumulates the error over time, gradually compensating for the changing load due to the evaporation of moisture from the lumber. The adjustable parameter for the Integral term is the reset rate T expressed in minutes per reset. A mechanism termed the Anti-Reset Windup stops the accumulation of error when the controller output exceeds a maximum value or drops below zero.

Derivative:

The Derivative term of equation 1 accounts for the rate at which the error term approaches or deviates from the set point. This term has very little effect in a process that varies as slowly as a drying cycle.

All three modes of the PID algorithm are used to maintain the Dry bulb set points. The Wet bulb set points are controlled by using only the Proportional and Integral modes in a duplex action. When the Wet bulb temperature is below the set point, the controller introduces steam through spray nozzles 34 to increase the humidity in the kiln; when the wet bulb temperature exceeds the set point, the controller opens the vents 28 to allow the excess moisture in the kiln to escape. Venting is the normal action throughout the drying schedule as moisture constantly evaporates from the lumber as the kiln dries. The wet bulb control employs a dead band around the set point in which neither venting or spraying takes place thereby smoothing the transition from one action to the other.

Figure 6:
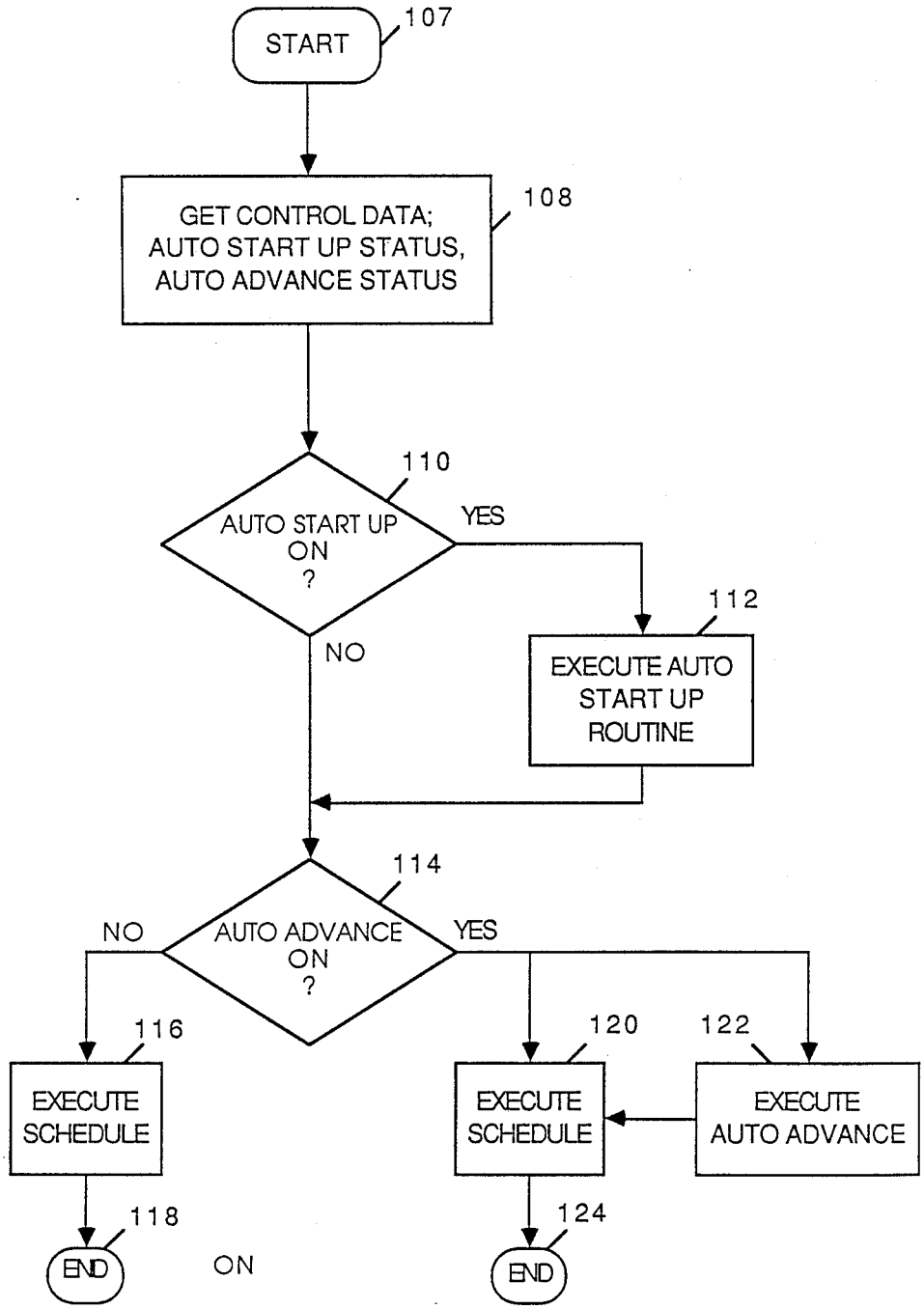
FIGS. 6–10 are flow charts illustrating operation of the computer in FIG. 3 in carrying out the present invention.
Figure 7:
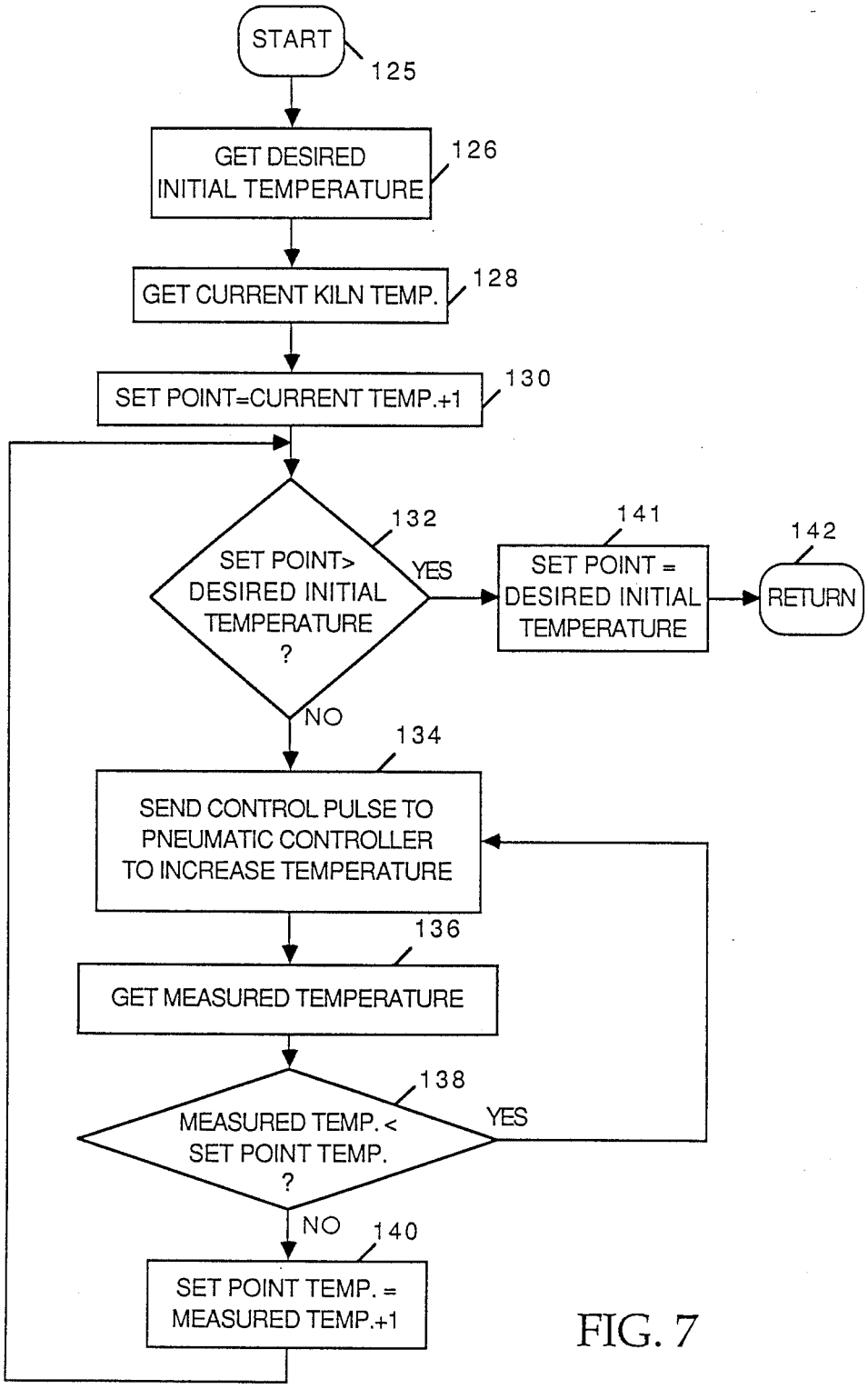
Figure 8:
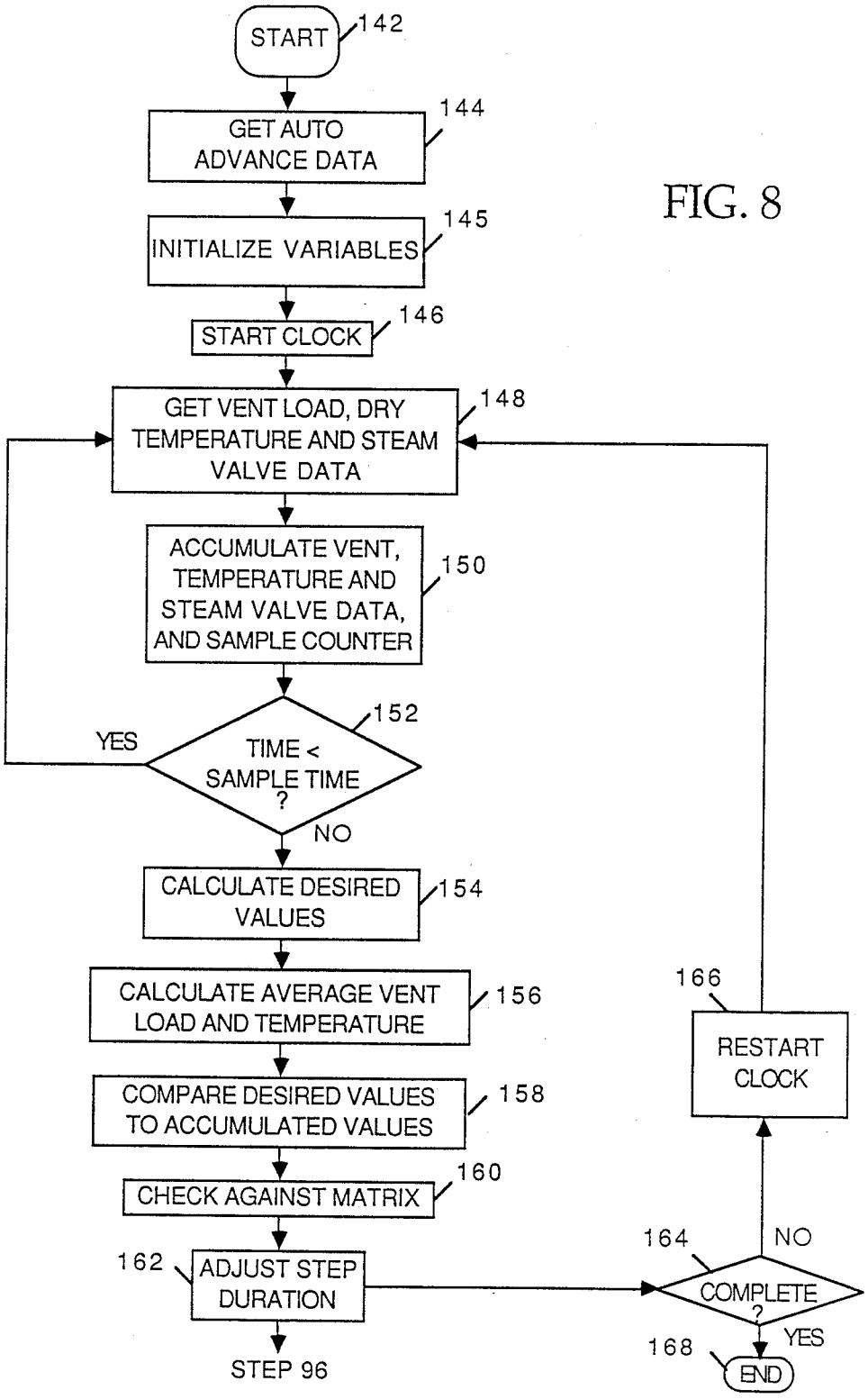
Figure 9:
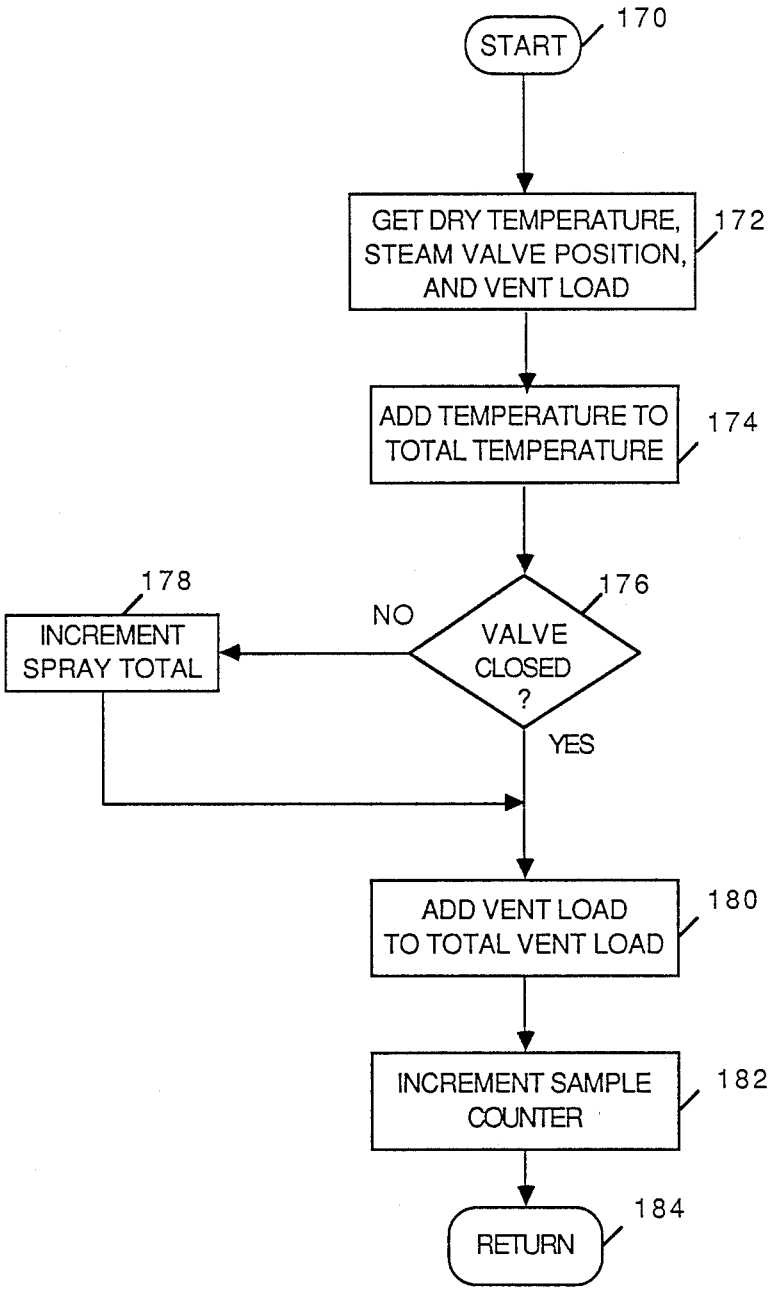
Figure 10:
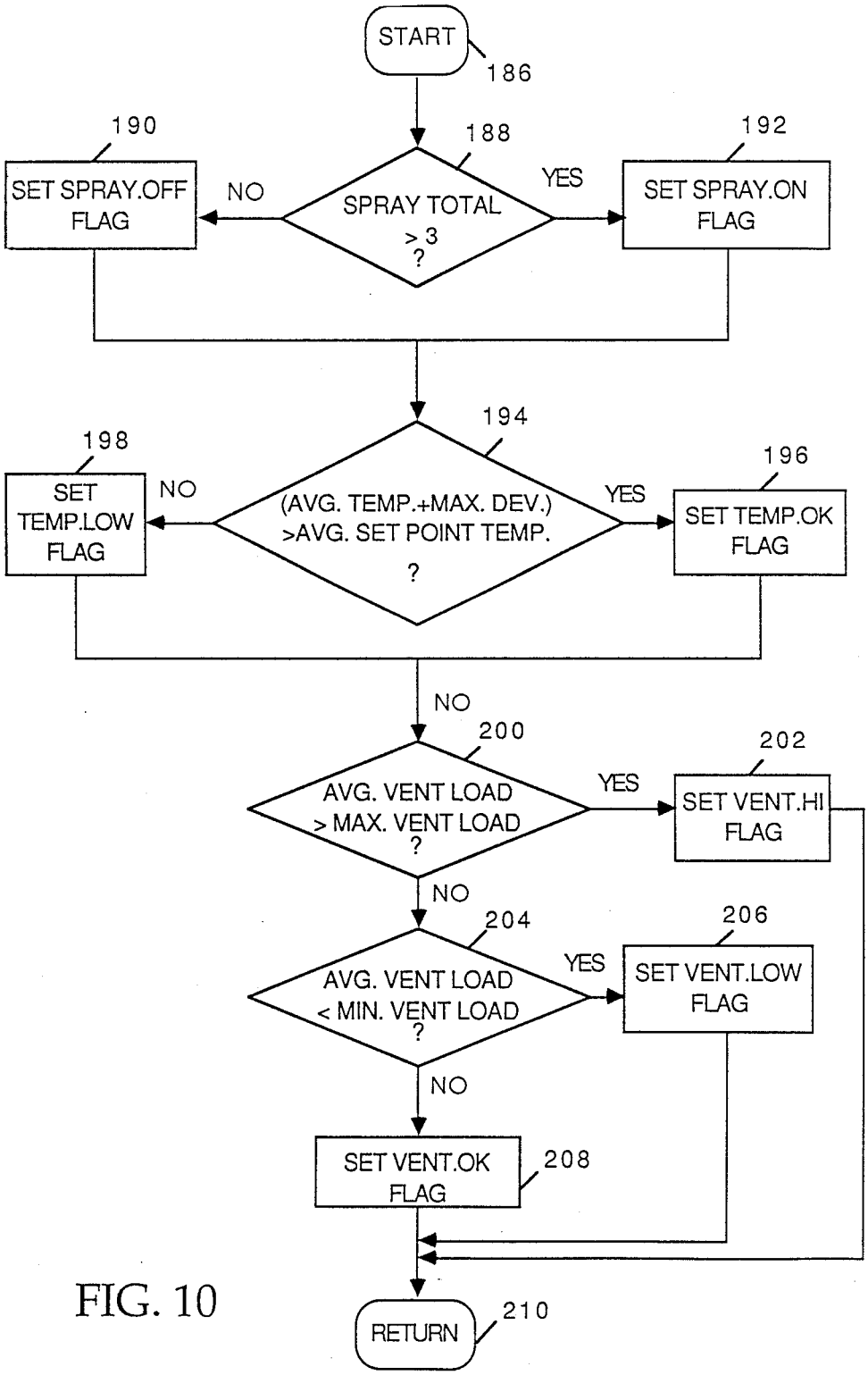

In accordance with the invention, computer 56 responds to an "auto start up" command from the user via user interface 60 by executing an auto start up routine preceding the normal execution of the drying schedule whereby the computer automatically controls the heating coils in the kiln to increase the kiln temperature to a desired initial temperature. Further in accordance with the invention, computer 56 responds to an "auto advance" command from the user via user interface 60 by executing an auto advance routine in concurrence with the normal execution of the drying schedule whereby the computer automatically monitors the vent load, temperature and spray nozzle activity and adjusts the duration of the current step in the schedule accordingly. FIG. 6 is a flow chart showing the integration of the auto start up and auto advance routines with the normal execution of the drying schedule. FIG. 7 is a flow chart for the auto start up routine carried out by computer 56. FIG. 8 is a flow chart of the auto advance routine carried out by computer 56, while FIGS. 9–10 illustrate various steps of the flow chart of FIG. 8 in more detail.

Referring to FIG. 6, computer 56 commences the drying schedule by obtaining control data indicating the status of the auto start up routine as well as the status of the auto advance routine from the user via user interface 60 (step 108). The computer checks to see if the auto start up routine is on in step 110. If the auto start up is active, the computer executes the auto start up routine at step 112 thereby bringing the kiln up to the desired initial temperature. If the auto start up is not active the program proceeds directly to step 114. At step 114, the computer determines whether the auto advance routine is on. If the auto advance is not active, the program executes the drying schedule in the normal manner described hereinabove (step 116) and then ends at step 118. The auto-advance feature is actuated by a button on the user interface and may be activated or de-activated at any point during the drying schedule.

When the auto advance is active, the computer executes the drying schedule (step 120) together with the auto advance routine (step 122) concurrently. The auto advance routine monitors the vent load, spray nozzle activity and kiln temperature, followed by accordingly adjusting the duration of the current step in the drying schedule. The auto advance routine functions until the drying schedule is completed whereby the program ends at step 124, or the user via user interface 60 deactivates the auto advance routine.

Referring to FIG. 7, when the auto start up routine is active it pre-empts the first step of the drying schedule wherein the kiln temperature is slowly ramped up to the desired initial temperature. The auto start up routine bypasses the normal ramping pattern for generating the intermediate set point temperatures for the first step of the drying schedule. The pattern used by the auto start up routine allows the set point temperatures to rise quickly in the beginning when primarily air is being heated but allows the set points to rise slowly when the lumber and kiln walls are being heated. This routine optimizes the time and energy needed to reach the desired initial temperature while insuring that the desired initial temperature will be achieved.

Computer 56 receives the desired initial temperature from the drying schedule in step 126. The current kiln temperature from dry bulb sensor 40 is obtained (step 128) and the computer sets the set point to one degree above the current kiln temperature (step 130). At step 132, the current set point is compared with the desired initial temperature (step 132) and if the current set point does not exceed the desired initial temperature, the appropriate control pulses are sent to the pneumatic controller directing it to increase the temperature in the kiln (step 134). Then, the computer accesses the current measured kiln temperature (step 136) for comparison with the current set point temperature (step 138). Steps 134, 136, and 138 are repeated until the measured temperature reaches the set point temperature. The kiln temperature will increase rapidly and surpass the set point because during start up primarily the air in the kiln is being heated. When the measured temperature reaches the set point temperature, the computer adjusts the set point temperature to be one degree higher than the measured temperature (step 140). Steps 132–140 are repeated until the current set point temperature surpasses the desired initial temperature at step 132 whereby the set point temperature is set equal to the desired initial temperature in step 141 thus ending the auto start up routine. Return is made (step 142) to step 114.

Referring to FIG. 8, when the auto advance routine is active, the computer executes the drying schedule as described hereinabove simultaneously with the auto advance routine. The auto advance routine interacts with the drying schedule to adjust the duration of the current step, thereby drying the lumber more efficiently. For example, at a given EMC (drying force), the moisture in the lumber will only evaporate to a certain level of moisture content. To draw more moisture from the lumber, the EMC must be decreased. Therefore, if the vent load is low, the duration of the current step can be shortened. In a HOLD step, where the force on the lumber does not change, decreasing the length of the step will save time and energy. In a RAMP step, the effect of shortening the step will be to increase the EMC at a faster rate, thereby forcing more moisture out of the lumber. Conversely, if the vent load exceeds the desired level, the step duration is lengthened so that all the moisture is removed at a particular EMC before progressing with the schedule.

First, the computer obtains the auto advance data from the back panel parameters 62 including the sample time, beginning minimum vent load, ending minimum vent load, maximum vent load, maximum temperature deviation and the maximum number of times the spray nozzle supplies steam to the kiln (step 144). The sample time is the number of minutes taken to collect data for use in the auto advance decision. The minimum vent load is given in tenth pounds of pressure seen on the vent actuation, which corresponds to the minimum rate for extracting water from the lumber. This minimum vent load may be programmed as a constant value, or it may be varied evenly from a beginning value to an ending value over the drying schedule's total time. The value for minimum vent load starts out at the beginning minimum vent load value, and is then evenly varied until it equals the ending minimum vent load value at the end of the drying schedule. The maximum vent load is given in tenth pounds of pressure seen on the vent actuator, corresponding to the maximum rate for extracting water from the lumber. The maximum difference is the maximum temperature deviation between the dry bulb set point temperature and the actual dry bulb temperature allowable before the temperature deviation is interpreted to have resulted from a loss of steam into the kiln.

The computer initializes the variables used for obtaining and accumulating the kiln data to zero (step 145). The computer's internal clock is started for monitoring the running time of the current auto advance cycle (step 146). The computer accesses the current vent load, dry temperature and the position of steam valve 26 (step 148) and accumulates the data (step 150). (The position of steam valve 26 indicates whether or not spray nozzle 34 supplies steam to the kiln.) Steps 148 and 150 are described in more detail in connection with FIG. 9.

In step 152, the computer checks the clock time and compares it to the sample time. Steps 148, 150, and 152 are repeated until the clock time reaches the sample time. Then, the computer calculates the desired average vent load from the back panel parameters and calculates the desired average temperature from the set points prescribed in the drying schedule (step 154). The average measured vent load and the average measured temperature are calculated from the data accumulated in step 150 (step 156), with the calculated measured values and desired values being compared in step 158. The appropriate flags are set accordingly. Step 158 is shown in more detail in FIG. 10.

The flag settings are compared to the matrix shown in table 1 below (step 160) and the duration of the current step in the drying schedule is adjusted as called out by the matrix (step 162). The auto advance routine passes the adjusted values of the step duration to step 96 in FIG. 5. The length of increase or decrease in the step duration is equal to the sample time of the auto advance routine. The computer checks to see if the drying schedule is completed in step 164. If the schedule is still being executed, the clock is restarted (step 166), with steps 148–166 being repeated until the schedule is completed in step 164, whereby the auto advance routine ends at step 168.

FIG. 9 describes steps 148 and 150 of obtaining and accumulating the data. The computer receives the current kiln temperature, steam valve position and vent load from the appropriate sensors (step 172) and accumulates the data. The current temperature is added to the total temperature (step 174). The computer determines whether the steam valve is currently open or closed (step 176); if the valve is open, the spray total is incremented with step 180 being executed (step 178) wherein spray total indicates the number of times steam valve 26 was opened allowing spray nozzle 34 to supply steam to the kiln. Otherwise the computer performs step 180 of adding the current vent load to the total vent load immediately following the execution of step 176; the sample counter is incremented (step 182). Return is made to execute step 152 in FIG. 8 (step 184).

FIG. 10 illustrates step 158 of FIG. 8 in more detail. The computer compares the spray total to a maximum number of times the steam valve 26 should be opened, suitably 3 (step 188) and sets a spray.off flag if the spray total is less than or equal to 3 (step 190), or sets a spray.on flag if it exceeds 3 (step 192). The average kiln temperature plus a maximum allowable deviation is compared to the average set point temperature (step 194). If the average temperature plus the deviation exceeds the average set point temperature, the computer sets the temp.ok flag (step 196). If not, the temp.low flag is set (step 198). In step 200, the computer determines whether the average vent load exceeds the maximum vent load (step 200) and if it does exceed the maximum vent load, the computer sets the vent.hi flag (step 202) and returns (step 210) to step 158 of FIG. 8. A high vent load indicates that the kiln had to vent a lot to maintain the desired humidity level because a great deal of moisture was being evaporated out of the lumber. If the average vent load does not exceed the maximum vent load, it is determined whether the average vent load is less than the minimum vent load (step 204). If the average vent load is less than the minimum vent load, the vent.low flag is set (step 206) with the program returning (step 210) to step 158 of FIG. 8. This corresponds to a low evaporation rate which indicates that the lumber was drier than expected when the schedule was created. If the average vent load is not less than the minimum vent load, the computer sets the vent.ok flag (step 208) and returns (step 210) to step 158 of FIG. 8.

Table 1 below shows a matrix of flag settings suitably used in step 160 to determine how the duration of the current step will be adjusted in step 162. Retarding the schedule corresponds to lengthening the duration of the current step, while advancing the schedule corresponds to shortening the duration of the current step of the drying schedule.

TABLE 1

| vent load | dry temp. | spray | choice |
|---|---|---|---|
| low | low | off | retard |
| low | low | on | normal |
| low | ok | off | advance |
| low | ok | on | normal |
| ok | low | off | retard |
| ok | low | on | normal |
| ok | ok | off | normal |
| ok | ok | on | normal |
| high | low | off | retard |
| high | low | on | normal |
| high | ok | off | retard |
| high | ok | on | normal |

The kiln controller in the embodiment described hereinabove executes a drying schedule for drying lumber in a kiln whereby the controller brings the kiln to a desired initial temperature, adjusts the temperature and humidity in the kiln to meet the conditions prescribed in the drying schedule, and adjusts the duration of the current step in the drying schedule. By utilizing the auto start up routine to achieve the initial temperature, together with the auto advance routine to adjust the schedule, the controller executes a drying schedule that reflects the drying requirements of the lumber more accurately, thereby improving the quality of the dried lumber, controlling the moisture content of the lumber and doing so in a manner that saves time and energy.

Furthermore, as an alternative embodiment, the controller can adjust the drying schedule by changing the dry and wet temperature set points as well as the duration of the current step based on the data fed back from the kiln. For instance, in a case where the duration of the step is shortened because the vent load indicates low humidity levels in the kiln, the temperature set points can be adjusted to increase the wet bulb depression thereby applying a greater drying force on the lumber. Conversely, when the step is lengthened because the vent load indicates high humidity levels, the temperature set points can be adjusted to reduce the drying force on the lumber.

While plural embodiments of the present invention have been shown and described, it will be apparent to those skilled in the art that many changes and modifications may be made without departing from the invention in its broader aspects. The appended claims are therefore intended to cover all such changes and modification as fall within the true spirit and scope of the invention.

We claim:

1. In a kiln controller for controlling the drying of lumber in a kiln, and comprising measuring means for measuring an evaporation rate of moisture in the lumber, and a computer controlling a schedule for drying the lumber, the schedule having a plurality of steps of variable duration, each step having temperature set points, a method comprising the steps of:

(a) comparing the measured evaporation rate to a desired evaporation rate, (b) adjusting the schedule in accordance with the comparison between the measured and desired evaporation rates, and (c) repeating (a) and (b) until the schedule is completed;

wherein the kiln has a vent with a plurality of positions, and wherein measuring the evaporation rate comprises measuring a vent load of the vent, said vent load indicating the position of the vent.

2. The method as recited in claim 1 wherein the kiln has a steam valve for introducing steam into the kiln.

3. The method as recited in claim 2 wherein measuring the evaporation rate further comprises measuring a temperature in the kiln.

4. In a kiln controller for controlling the drying of lumber in a kiln having a vent with a plurality of positions, and comprising measuring means for measuring a vent load of the vent, the vent load indicating the position of the vent, and a computer controlling a schedule for drying the lumber, the schedule having a plurality of steps of variable duration, each step having temperature set points, a method comprising the steps of:

(a) comparing the measured vent load to a desired vent load, (b) adjusting the duration of the step in the schedule in accordance with the comparison of the measured and desired vent loads, the duration of the current step being increased when the measured vent load exceeds the desired vent load by a predetermined amount, and (c) repeating steps (a) and (b) until the schedule is complete.

5. The method as recited in claim 4 wherein the duration of the step is decreased when the measured vent load is less than the desired vent load by a predetermined amount.

6. The method as recited in claim 4 wherein the measuring means further measures a humidity level in the kiln, and further comprising the steps of:

(d) comparing the measured humidity level to a desired humidity level, (e) when the measured humidity level exceeds the desired humidity level, opening the vent, and (f) repeating steps (d) and (e) concurrently with steps (a) and (b) until the schedule is completed.

7. The method as recited in claim 6, wherein the kiln has a steam valve for selectively introducing steam into the kiln, and further comprising the step, between steps d and e, when the measured humidity level is less than the desired humidity level, opening the steam valve to introduce steam into the kiln.

8. In a kiln controller for controlling the drying of lumber in a kiln having a vent with a plurality of positions, and comprising heating means for heating the kiln, measuring means for measuring a vent load of the vent, and a computer controlling a schedule having a plurality of steps of variable duration, each step having desired dry and wet temperature set points, a method for the controller comprising the steps of:

(a) heating the kiln to the desired dry and wet temperature set points, (b) measuring the vent load of the vent, (c) comparing the vent load to a desired vent load, (d) adjusting the duration of the step in accordance with the comparison of the measured and desired vent loads, and (e) repeating steps (a) through (d) until the schedule is completed.

9. In a kiln controller for controlling the drying of lumber in a kiln, and comprising heating means for heating the kiln, measuring means for measuring a temperature in the kiln, and a computer for controlling said heating means to increase the temperature in the kiln to a final set point temperature, a method for operating said computer comprising the steps of:

(a) comparing the measured temperature to a set point temperature;

(b) when the measured temperature exceeds the set point temperature, increasing the set point temperature so that it exceeds the measured temperature;

(c) using the set point temperature to adjust the heating means so that the temperature in the kiln increases; and (d) repeating step a through c until the measured temperature reaches the final set point temperature.

10. A kiln controller for controlling the drying of lumber in a kiln having a vent being controlled for expelling humid air from said kiln substantially in accordance with a variable position thereof, said controller comprising:

means for executing a drying schedule having a plurality of steps of varying duration, each step having temperature set points, means for measuring the position of the vent, means for comparing the measured position of the vent to a desired vent position, and means for adjusting the schedule in accordance with the comparison of the measured and desired vent positions.

11. In a kiln controller for controlling the drying of lumber in a kiln, and comprising means responsive to the evaporation rate of moisture in lumber for providing a measure of said evaporation rate, and a computer controlling a schedule for drying the lumber, the schedule having a predetermined plurality of steps of variable duration, each step having temperature set points, a method comprising:

(a) comparing the first mentioned evaporation rate in said lumber to a desired evaporation rate, (b) adjusting the schedule in accordance with the comparison between the first mentioned evaporation rate and the desired evaporation rate by adjusting the duration of a current step, and (c) repeating (a) and (b) for a plurality of steps until the schedule is completed.

12. The method as recited in claim 11 wherein the duration of the current step is lengthened when said evaporation rate is high and wherein the duration of the current step is shortened when said evaporation rate is low.

13. The method as recited in claim 11 wherein said first mentioned evaporation rate corresponds to an average evaporation rate over time.

14. The method as recited in claim 11 further including changing one or more of said temperature set points of a current step in accordance with the comparison between the first mentioned evaporation rate and the desired evaporation rate.

* * * * *